United States Patent [19]

Wagemann

[11] Patent Number: 4,696,651

[45] Date of Patent: Sep. 29, 1987

[54] APPARATUS FOR A SHIP'S PROPELLER

[75] Inventor: Harry Wagemann, Hamburg, Fed. Rep. of Germany

[73] Assignee: Blohm & Voss AG, Hamburg, Fed. Rep. of Germany

[21] Appl. No.: 804,279

[22] Filed: Dec. 3, 1985

[30] Foreign Application Priority Data

Dec. 4, 1984 [DE] Fed. Rep. of Germany ..... 3444084

[51] Int. Cl.[4] ..... B63H 1/28

[52] U.S. Cl. ..... 440/88; 416/90 A; 416/93 A

[58] Field of Search ..... 440/88, 89, 78, 83; 416/90 A, 90 R, 93 A, 93 R, 92

[56] References Cited

U.S. PATENT DOCUMENTS

| | | | |
|---|---|---|---|
| 3,407,779 | 10/1968 | Satterthwaite | 440/83 |
| 3,583,356 | 6/1971 | Barker | 440/83 |
| 3,851,983 | 12/1974 | MacKenzie | 440/83 |
| 4,050,848 | 9/1977 | White | 416/146 |
| 4,142,829 | 3/1979 | Inoue et al. | 416/25 |
| 4,150,921 | 4/1979 | Wennberg et al. | 416/207 |
| 4,188,906 | 2/1980 | Tachmindji et al. | 115/34 |
| 4,436,482 | 3/1984 | Inoue et al. | 416/1 |
| 4,436,514 | 3/1984 | Takahashi | 440/89 |
| 4,474,533 | 10/1984 | Hino | 416/157 |
| 4,545,771 | 10/1985 | Iio | 440/89 |

FOREIGN PATENT DOCUMENTS

| | | | |
|---|---|---|---|
| 3005680 | 3/1984 | Fed. Rep. of Germany | 440/88 |

*Primary Examiner*—Jeffrey V. Nase
*Assistant Examiner*—C. T. Bartz
*Attorney, Agent, or Firm*—Nils H. Ljungman

[57] ABSTRACT

An apparatus for a ship's propeller, whose fins, which may be pitch-controlled, are provided in the vicinity of the leading edges with air openings. These air openings are fed via air ducts in each propeller fin by a compressed air source located in the ship. The compressed air is fed from the ship's compressor to the propeller by an air coupling which is protected by a split covering sleeve. The coupling is fed by an air feed line laid outside the ship's hull along the stern post or propeller strut. The air feed line penetrates the covering sleeve between the propeller strut and the propeller. The air line is connected to a two-piece inlet feed fitting. Air is fed from the inlet fitting through a two-piece bypass ring which rotates with the propeller shaft, to a two-piece air discharge fitting connected to the propeller hub.

14 Claims, 2 Drawing Figures

APPARATUS FOR A SHIP'S PROPELLER

CROSS REFERENCE TO CO-PENDING APPLICATION

Co-pending applicaton Ser. No. 733,869, filed on May 14, 1985, entitled "Apparatus For Adjusting And Locking Pitch Of A Variable Pitch Propeller On A Ship", is assigned to the same assignee as the instant application and is incorporated herein by reference as if fully set forth herein.

BACKGROUND OF THE INVENTION

1. Field of the Invention

The present invention relates to cavitation in propellers and, more particularly, to an arrangement for providing air to a propeller for reducing cavitation.

2. Description of the Prior Art

Cavitation has many deleterious effects on the operation of a ship and the components associated with propulsion thereof. Especially in warships, which operate at high speeds which may produce cavitation, the effects of cavitation are especially deleterious. No only does cavitation reduce performance of a warship, but since warships preferably should move through the water with stealth, as quietly as possible in order to avoid detection by listening devices, there has been a great need for a reduction and minimization of cavitation in ships and especially warships.

Cavitation caused by the rotation of a fixed or a controllable-pitch propeller generates noise which can easily be detected by modern, sophisticated devices available for military use today. To reduce the propagation of noise caused by cavitation, it is known that air can be fed into the vicinity of the leading edges of the propeller blades or fins. The air is released therefrom to aid in the dissipation and minimization of the noise created by the cavitation, or to prevent a potentially cavitating propeller from cavitating. Such an arrangement is described in the German Patent Publication Laid Open for Opposition Purposes No. DE-OS 30 05 680 which is incorporated herein by reference as if the full text thereof is set forth herein. Another example of a cavitating propeller having air ejection is found in U.S. Pat. No. 4,188,906 which is entitled "Supercavitating Propeller with Air Ventilation" which is incorporated herein by reference as if the full text thereof is set forth herein. In this U.S. patent, a method of decreasing the deleterious effects of cavitation on a ship propeller is accomplished by ejecting air from the suction side of each propeller blade when the ship speed and propeller speed reach a predetermined point which thereby could produce a cavity which extends from the leading edge to a point in the water beyond the trailing edge of the propeller and may envelope the entire section of the blade.

Hitherto, the retrofitting of a propeller with air injection to reduce cavitation has included a very high expense of fitting the ship with such an air feed installation. In addition, the maintenance of prior art air ejection systems has been very high and therefore, not practical especially in the case of a war vessel.

Controllable pitch propellers are known in the prior art, some examples of which are U.S. Pat. No. 4,474,533 entitled "Controllable Pitch Propeller Assembly", U.S. Pat. No. 4,436,482 entitled "Constant Ship Speed Control Method" which discloses a method of controlling the speed of a ship equipped with a controllable pitch propeller. Another example is disclosed in U.S. Pat. No. 4,142,829 entitled "Compound Remote Control Device for the Propulsion Engine of a Ship's VariablePitch Propeller". Yet another example is disclosed in U.S. Pat. No. 4,150,921 entitled "Built-Up Marine Propellers with Adjustable Pitch and Axial Removal Blades". All of the above U.S. patents are incorporated herein by reference.

Typically, ships have no room left for the addition of any equipment to the propeller or other portions thereof associated therewith after the time of building. Therefore, retrofitting is an extremely difficult problem which requires special equipment which heretofore has not been generally available.

OBJECTS OF THE INVENTION

An object of the invention is to provide a simple and effective means of retrofitting a ship with an air feed installation system for its propeller.

A further object of the invention is to eliminate the disadvantages of the prior art.

A yet further object of the invention is to provide an air transfer system from the hull of the ship to the propeller blade.

A still further object of the invention is to provide a relatively simple air feed installation which connects the ships's hull and the propeller.

SUMMARY OF THE INVENTION

The present invention solves the existing problem of retrofitting ships with air feed equipment which have not been specifically designed to incorporate same at the time of building or refitting.

With the present invention, a ship can be refitted with a subsequent air feed installation in the shortest possible time. The advantage of the present invention essentially results from the fact that compressed air is provided to the propeller by a feed line which is fastened externally to a propeller strut or a stern post. In order to reduce costs of part and simply refitting and installation of the invention onto a ship, a great number of the parts have been made identical to one another, thereby making fabrication more economical, and installation and storage simpler.

The invention resides broadly in an air coupling for a propeller of a ship, said propeller having propeller blades, which propeller blades have means for ejecting air therefrom, said air coupling being for connecting an air compressor on said ship through an air conduit with said propeller for providing compressed air to said ejecting means, said air coupling comprising: stationary means for accepting air from said air conduit and for feeding said air; said stationary air feed means having means for attachment thereof to said air conduit; a propeller shaft rotatable air feed sleeve being mounted on said propeller shaft and for rotating with said propeller shaft; a rotatable means for feeding air to and rotating with said propeller; said sleeve for accepting air from said stationary means and feeding air to said rotating means when installed, said stationary means having means for feeding air to said rotatable air feed sleeve when installed; said sleeve having means for feeding air from said stationary means to said rotatable means, and said rotatable means having means for feeding air from said sleeve to said propeller; said stationary means and said sleeve and said rotating air feed means for being disposed when assembled to feed air from said stationary means through said propeller shaft rotatable sleeve to said rotating air feeding means and to said propeller; and said stationary means, said rotating means and said rotating sleeve each comprising at least two parts each, each of said at least two parts of each of said stationary means, said rotating means and said rotating sleeve each having adjacent surfaces when installed.

The invention further resides broadly in a kit for an air coupling for feeding compressed air compressed in a hull of a ship to a propeller of said ship; said propeller having propeller blades, said propeller having means for ejecting air from said propeller blades, said kit being installable, removable and serviceable when said propeller is installed on said ship, said kit being connectable with any air conduit providing compressed air from within said ship to said kit when installed, connecting an air compressor on said ship through an air conduit with said propeller for providing compressed air to said ejecting means, said kit comprising: stationary means for accepting air from said air conduit and for feeding said air; said stationary air feed means having means for attachment thereof to said air conduit; a propeller shaft rotatable air feed sleeve being mounted on said propeller shaft and for rotating with said propeller shaft; a rotatable means for feeding air to and rotating with said propeller; said sleeve for accepting air from said stationary means and feeding air to said rotating means when installed, said stationary means having means for feeding air to said rotatable air feed sleeve when installed; said sleeve having means for feeding air from said stationary means to said rotatable means, and said rotatable means having means for feeding air from said sleeve to said propeller; said stationary means and said sleeve and said rotating air feed means for being disposed when assembled to feed air from said stationary means through said propeller shaft rotatable sleeve to said rotating air feeding means and to said propeller; and said stationary means, said rotating means and said rotating sleeve each comprising at least two parts each, each of said at least two parts of each of said stationary means, said rotating means and said rotating sleeve each having adjacent surfaces when installed.

The parts of the apparatus which accept feed air from the air feed line and discharge air into the propeller structure are made identical to one another, thereby making fabrication thereof more economical by eliminating duplication of parts, machining operations, etc. In this particular invention, these parts, only one type of which has any wear associated therewith in addition to the bypass ring connecting them is exposed to wear due to a rotary motion at one portion of an embodiment of the invention. By such an innovation, that is, the feed and discharge lines being identical, a ready made replacement is provided because since only one portion of the invention wears due to rotary motion and both portions of the structure are identical, the non-rotating structure can replace the rotating structure when the seal in the rotating structure is not sufficiently operable for practical use. The interchanging and reversal of the parts involved is very simple and can be done even where no replacement parts are available. A dive team could even perform this exchange of parts without the need for a call to a port.

Another advantage resides in that the air feed line does not require check valves since the air feed line runs directly up and is connected to the hull of the ship above the water line, thereby providing for safe transmission of air to the feed line. Therefore, seawater penetrating into the air feed line cannot cause problems such as leakage of seawater into the hull of the ship.

BRIEF DESCRIPTION OF THE DRAWINGS

The invention is explained below with reference to drawings of one embodiment.

DESCRIPTION OF THE PREFERRED EMBODIMENT

Figure 1:
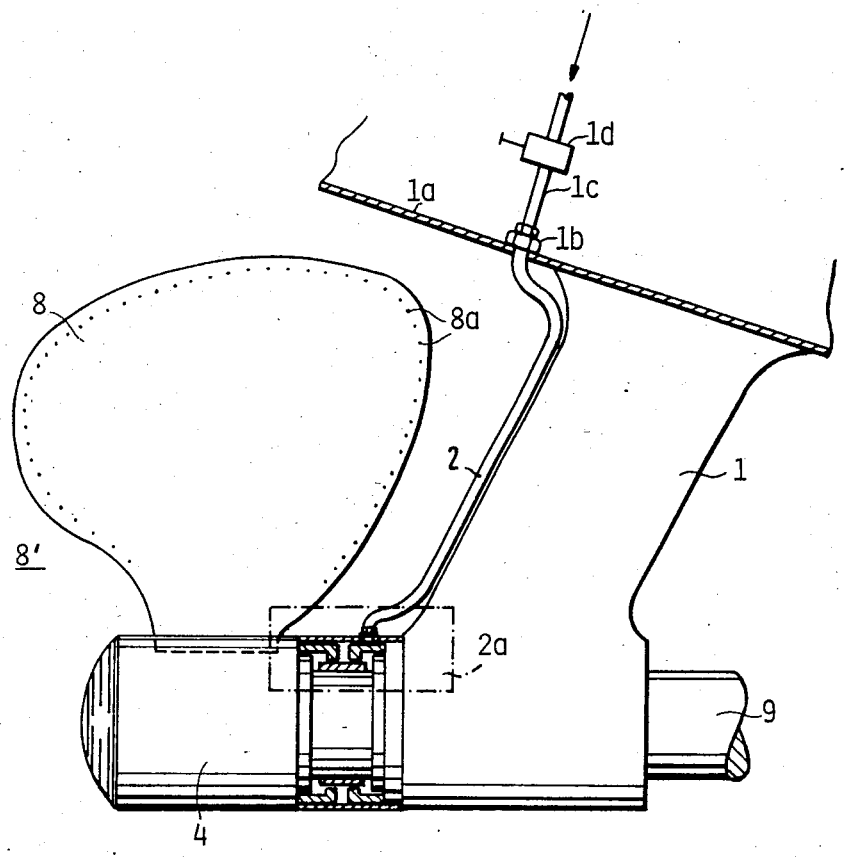
FIG. 1 shows an overall view, in partial cross section, of the mounting of the propeller shaft with propeller in the propeller strut of a ship according to the invention.

FIG. 1 shows a propeller strut 1 which has a compressed air line 2 fastened to the rear edge thereof by means (not shown). The fastening means may be of any several means such as straps and bolts or other fastenings known in the prior art. The air feed line 2 is preferably a thick wall feed line for conducting the compressed air compressed in the hull 1*a* of a ship by compressors (not shown) well known in the prior art. The hull 1*a* of the ship has a fitting 1*b* connected therein which permits the passing through of the compressed air from within the ship to the compressed air feed line 2 outside the ship. Also connected to this fitting 1*b* is a compressed air feed line 1*c* which has a valve connected thereon which controls the flow of air through the feed line 2. In the event of an emergency or when the compressed air is no longer needed during operation of the ship, a valve 1d connected to provide air to the feed line 2 can be closed. The air from the compressed air line 2 is fed into a coupling 2*a* which is shown in greater detail in FIG. 2. The propeller strut 1 is disposed to accept a propeller shaft 9 therethrough and for steadying same during operation. The air from the compressed air feed line 2 is fed through the coupling 2*a* into a hub of the propeller 4 from which a plurality of propeller blades 8 protrude forming the propeller 8'. Only one of the blades 8 is shown in FIG. 1 for purposes of simplicity. About the periphery of the propeller blade 8 are disposed a plurality of orifices 8*a* which eject the compressed air from the blade to reduce or minimize cavitation effects when required.

Figure 2:
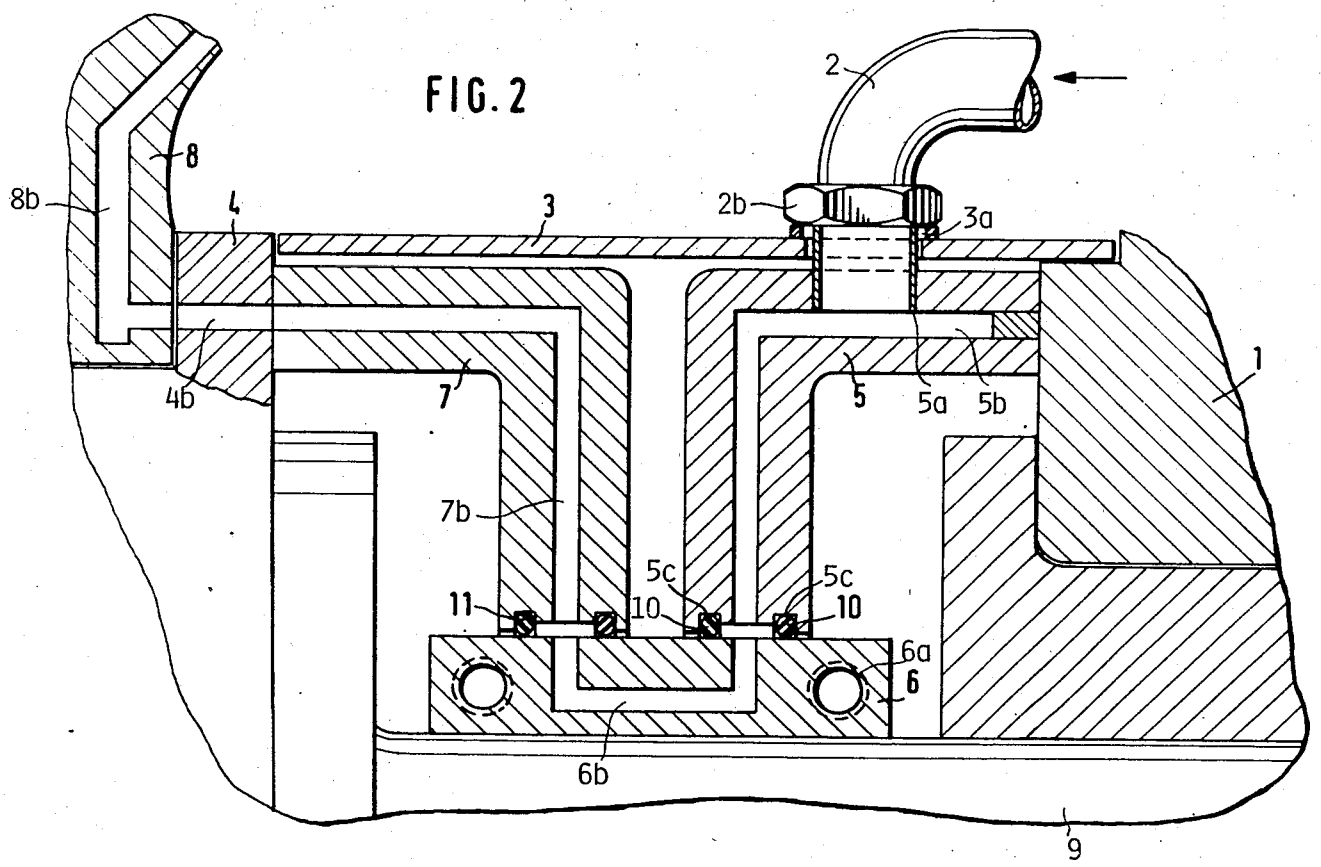
FIG. 2 shows a detail from FIG. 1 on a larger scale and in section through the propeller shaft.

Referring now to FIG. 2, the compressed air line 2 is connected through a coupling fitting 2*b* to an easily removable protective sleeve 3 which is fastened to the propeller strut 1 so that it does not rotate with the propeller hub 4. The fitting 2*a* connects the compressed air feed line 2 in a substantialy air-tight manner through an orifice 3*a* in the removable protective sleeve 3 to a stationary air feed fitting 5 which has an orifice 5*a* therein aligned with the orifice 3*a* in the protective sleeve 3. Sealing is provided thereabout (not shown) to prevent or substantially prevent the leakage of air from the orifice 5*a*. The stationary air feed fitting 5 is connected to the propeller strut 1 in such a way that the air does not leak from the stationary air feed fitting 5 at the connecting point therebetween. The compressed air is then fed through a passage 5*b* within the stationary air feed fitting 5 to a bypass ring or sleeve 6 which is cylindrical in shape and disposed about the propeller shaft 9 and rotates therewith. For simplicity of installation and removal, the bypass ring 6 is preferable formed from two halves which are semicircular in cross section and fit about the propeller shaft 9, as can be seen in greater detail in FIG. 1. The two halves of the bypass ring 6 are preferably provided with threaded holes 6a into which bolts can be threaded to fasten the two halves of the bypass ring 6 together. The bypass ring 6 has at least one passage 6b preferably substantially aligned with the orifice 5b. In order to prevent air leakage, between the rotating bypass ring 6, which is attached to the propeller shaft 9 and rotating therewith, a pair of gaskets or seals 10 are disposed in grooves 5c in stationary air feed fitting 5 in order to prevent the leakage of air between the stationary air feed fitting 5 and the bypass ring 6. An air passage 6b may be one or more passages in the bypass ring 6. A rotatable air feed fitting 7 is disposed in preferably substantial alignment with the passage 6b and is connected to the propeller hub 4 through an air passage 7b with an air passage 4b in the propeller hub 4. Seals 11 substantially identical, and preferably completely identical to the seals 10. of stationary air feed fitting 5 are disposed between the rotatable air feed fitting 7 and the bypass ring 6 and act in substantially the same way as the seals 10. However, in the case of seals 11, there is no relative rotary motion between the bypass ring 6 and the rotatable air feed fitting 7. Therefore, these seals 11 act in a static fashion and do not wear whereas seals 10 may wear during operation. The hub of the propeller 4 has an air passage 4b therein aligned with the air passage 7b of the air feed fitting. The propeller 8' has an air passage 8b aligned with the air passage 4b of the propeller hub 4. The bypass ring 6, the rotatable air feed fitting 7, the propeller hub 4 and the propeller 8' all rotate with the propeller shaft 9 whereas the stationary air feed fitting 5 and the protective sleeve 3 are stationary with respect to the hull. The stationary air feed fitting 5 and rotatable air feed fitting 7 are preferably also made in two parts which are preferably identical such that installation costs are minimized and maintenance is very flexible. In the case where the stationary air feed fitting 5 and rotatable air feed fitting 7, are made in two parts, they may be bolted together in a similar fashion to the bolting together as the preferably two parts of the bypass ring 6. In the case where parts 5 and 7, only one each of the parts 5 need to provide air to the bypass ring 6 and the other stationary air feed fitting 5 does not provide air thereto. If the propeller hub 4 does not have a means for distributing the air to the various propeller blades directly, a plurality of passages 7b can be provided in the rotatable air feed fitting 7 through a plurality of air passages 7b to the various blades 8 of the propeller 8'. The protective sleeve 3 is also preferably made in two pieces such that the installation is symmetrical with all respects, thereby also reducing chance of errors in installation. The stationary air feed fitting 5 is preferably bolted to the strut 1 for firm attachment thereto. The rotatable air feed fitting 7 is preferably bolted to the hub 4 for firm attachment thereto. All the components preferably made in two pieces may have even more pieces.

The invention as described hereinabove in the context of a preferred embodiment is not to be taken as limited to all of the provided details thereof, since modifications and variations thereof may be made without departing from the spirit and scope of the invention.

What is claimed is:

1. An air coupling for a propeller of a ship, said propeller having propeller blades, which propeller blades have means for ejecting air therefrom, said air coupling being for connecting an air compressor on said ship through an air conduit with said propeller for providing compressed air to said ejecting means, said air coupling comprising:

stationary means for accepting air from said air conduit and for feeding said air;

said stationary aid feed means having means for attachment thereof to said air conduit;

a propeller shaft rotatable air feed sleeve being mounted on said propeller shaft and for rotating with said propeller shaft;

a rotatable means for feeding air to and rotating with said propeller;

said sleeve for accepting air from said stationary means and feeding air to said rotating means when installed, said stationary means having means for feeding air to said rotatable air feed sleeve when installed;

said sleeve having means for feeding air from said stationary means to said rotatable means, and said rotatable means having means for feeding air from said sleeve to said propeller;

said stationary means and said sleeve and said rotating air feed means for being disposed when assembled to feed air from said stationary means through said propeller shaft rotatable sleeve to said rotating air feeding means and to said propeller and said stationary means, said rotating means and said rotating sleeve each comprising at least two parts each, each of said at least two parts of each of said stationary means, said rotating means and said rotating sleeve each having adjacent surfaces when installed.

2. The air coupling according to claim 1 wherein said stationary means, said rotating means and said rotating sleeve each comprises two substantially identical parts.

3. The air coupling according to claim 2 wherein said propeller shaft has a longitudinal axis extending from the propeller into said ship, said longitudinal axis being defined substantially within a center portion of said propeller shaft, said stationary means, said rotating means and said rotating sleeve each having a longitudinal axis, said longitudinal axes of said stationary means, said rotating means and said rotating sleeve when installed on said propeller shaft which longitudinal axes are substantially co-linear with said longitudinal axis of said propeller shaft, said substantially identical parts of said two parts of each of said stationary means, said rotating means and said rotating sleeve having surfaces for substantially abutting the other identical part of the same component, such that, the abutting surfaces of each part are substantially parallel with said longitudinal axes of said propeller shaft, said stationary means, said rotating means and said rotating sleeve.

4. The air coupling according to claim 3 wherein said stationary means comprises two semicircular parts which are attachable to a stationary portion of said ship, said two parts of said stationary means having means for attaching said two parts thereof together when installed.

5. The air coupling according to claim 4 wherein said rotating means comprises two semicircular parts which are attachable to propeller means of said ship, said two parts of said rotating means having means for attaching said two parts thereof together when installed.

6. The air coupling according to claim 5 wherein said sleeve comprises a split sleeve which is split into two substantially identical portions and which has at least one air duct therethrough, said substantially identical portions being substantially cylindrically semicircular and having means for attachment to one another on said propeller shaft and for being rotated thereby.

7. The air coupling according to claim 6 wherein said stationary means and said rotating means having seals for being disposed between the respective means and said rotating sleeve for sealing air within the structure of the three components when installed on said ship.

8. A kit for an air coupling for feeding compressed air compressed in a hull of a ship to a propeller of said ship; said propeller having propeller blades, said propeller having means for ejecting air from said propeller blades, said kit being installable, removable and serviceable when said propeller is installed on said ship, said kit being connectable with any air conduit providing compressed air from within said ship to said kit when installed, connecting an air compressor on said ship through an air conduit with said propeller for providing compressed air to said ejecting means, said kit comprising:

stationary means for accepting air from said conduit and for feeding said air;

said stationary air feed means having means for attachment thereof to said air conduit;

a propeller shaft rotatable air feed sleeve being mounted on said propeller shaft and for rotating with said propeller shaft;

a rotatable means for feeding air to and rotating with said propeller;

said sleeve for accepting air from said stationary means and feeding air to said rotating means when installed, said stationary means having means for feeding air to said rotatable air feed sleeve when installed;

said sleeve having means for feeding air from said stationary means to said rotatable means, and said rotatable means having means for feeding air from said sleeve to said propeller;

said stationary means and said sleeve and said rotating air feed means for being disposed when assembled to feed air from said stationary means through said propeller shaft rotatable sleeve to said rotating air feeding means and to said propeller; and said stationary means, said rotating means and said rotating sleeve each comprising at least two parts each, each of said at least two parts of each of the components of the kit having adjacent surfaces when installed whereby each of said two parts of each of said components is easily mountable and removable.

9. The kit for an air coupling for feeding air from a hull of a ship to a propeller of said ship according to claim 8 wherein said stationary means, said rotating means and said rotating sleeve each comprises two substantially identical parts.

10. The kit for an air coupling for feeding air from a hull of a ship to a propeller of said ship according to claim 9 wherein said propeller shaft has a longitudinal axis extending from the propeller into said ship, said longitudinal axis being defined substantially within a center portion of said propeller shaft; said stationary means, said rotating means and said rotating sleeve each having a longitudinal axis, said longitudinal axes of said stationary means, said rotating means and said rotating sleeve when installed on said propeller shaft which longitudinal axes are substantially co-liner with said longitudinal axis of said propeller shaft, said substantially identical parts of said two parts of each of said stationary means, said rotating means and said rotating sleeve having surfaces for substantially abutting the other identical part of the same component, such that, the abutting surfaces of each part are substantially parallel with said longitudinal axes of said propeller shaft, said stationary means, said rotating means and said rotating sleeve.

11. The kit for an air coupling for feeding air from a hull of a ship to a propeller of said ship according to claim 10 wherein said stationary means comprises two semicircular parts which are attachable to a stationary portion of said ship, said two parts of said stationary means having means for attaching said two parts thereof together when installed.

12. The kit for an air coupling for feeding air from a hull of a ship to a propeller of said ship according to claim 11 wherein said rotating means comprises two semicircular parts which are attachable to propeller means of said ship, said two parts of said rotating means having means for attaching two parts thereof together when installed.

13. The kit for an air coupling for feeding air from a hull of a ship to a propeller of said ship according to claim 12 wherein said sleeve comprises a split sleeve which is split into two substantially identical portions and which has at least one air duct therethrough, said substantially identical portions being substantially cylindrically semicircular and having means for attachment to one another on said propeller shaft and for being rotated thereby.

14. The kit for an air coupling for feeding air from a hull of a ship to a propeller of said ship according to claim 13 wherein said stationary means and said rotating means having seals for being disposed between the respective means and said rotating sleeve for sealing air within the structure of the three components when installed on said ship.

* * * * *